US011555614B2

(12) United States Patent
Hu et al.

(10) Patent No.: US 11,555,614 B2
(45) Date of Patent: Jan. 17, 2023

(54) OVEN SLIDE RAIL HANDLING MECHANISM WITH LOCKING FUNCTION

(71) Applicant: Jiangsu SARCAH Group Co., Ltd., Jiangsu (CN)

(72) Inventors: Tao Hu, Guangdong (CN); Jian Sun, Jiangsu (CN); Wenming Yang, Singapore (SG)

(73) Assignee: Jiangsu SARCAH Group Co., Ltd., Taizhou (CN)

( * ) Notice: Subject to any disclaimer, the term of this patent is extended or adjusted under 35 U.S.C. 154(b) by 20 days.

(21) Appl. No.: 17/137,414

(22) Filed: Dec. 30, 2020

(65) Prior Publication Data

US 2021/0116134 A1 Apr. 22, 2021

Related U.S. Application Data

(63) Continuation of application No. PCT/CN2018/115364, filed on Nov. 14, 2018.

(30) Foreign Application Priority Data

Sep. 3, 2018 (CN) ..... 201811020576.9

(51) Int. Cl.
*F24C 15/16* (2006.01)

(52) U.S. Cl.
CPC ..... *F24C 15/168* (2013.01)

(58) Field of Classification Search
CPC ..... F24C 15/168; F24C 15/16; A21B 1/50; A21B 3/07; A47B 88/40; A47B 88/43; A47B 2088/4278; A47B 88/423; A47B 88/473; A47B 88/477; A47B 2210/0081; A47B 2088/4235; Y10T 403/60; Y10T 403/608; Y10T 403/595; Y10T 403/30; Y10T 403/33; Y10T 403/43; Y10T 403/4363; Y10T 403/71; Y10T 403/7105;
(Continued)

(56) References Cited

U.S. PATENT DOCUMENTS

2001/0044992 A1* 11/2001 Jahrling ..... A47B 88/43 24/563
2011/0123260 A1* 5/2011 Budde ..... F16B 7/0433 403/188

(Continued)

FOREIGN PATENT DOCUMENTS

EP 2532273 A1 * 12/2012 ..... F24C 15/168

*Primary Examiner* — Steven B McAllister
*Assistant Examiner* — Cole N Friedman

(57) ABSTRACT

The present invention provides an oven slide rail handling mechanism with a locking function, comprising a connecting frame mounted on inner walls of both sides of an oven body, and a rail body, a lower rail of the rail body connects to a connecting component. The connecting component includes a guide snap and a front holder, the front holder and the guide snap are respectively mounted at two ends of bottom surface of the lower rail, the guide snap is provided with a snap-fitting position, and the front holder is provided with a latch rod. The mechanism is able to quickly assemble or disassemble the slide rail, is able to hold in multiple directions, and has locking function, preventing the slide rail from being disengaged from the connecting frame, improving the reliability of structural performance, ensuring the use effect of the slide rail and the use quality of an oven.

16 Claims, 6 Drawing Sheets

(58) Field of Classification Search
CPC ..... Y10T 24/44923; Y10T 403/7176; Y10T 24/344; Y10T 24/44769; F16B 7/0433; F16B 12/38; F16B 2/245; F16B 45/02
USPC ..... 126/273, 339; 403/24; 248/73, 226.11, 248/228.5, 214; 312/218, 334.12, 334.13, 312/228.1; 24/545; 108/143; 211/162, 211/151
See application file for complete search history.

(56) References Cited

U.S. PATENT DOCUMENTS

| | | | | |
|---|---|---|---|---|
| 2012/0090594 | A1* | 4/2012 | Rehage | F24C 15/168 126/339 |
| 2012/0145856 | A1* | 6/2012 | Reidt | F24C 15/168 248/226.11 |
| 2013/0156353 | A1* | 6/2013 | Rehage | A47B 88/43 384/22 |

* cited by examiner

OVEN SLIDE RAIL HANDLING MECHANISM WITH LOCKING FUNCTION

CROSS REFERENCE TO RELATED APPLICATIONS

The present application is a Continuation Application of PCT Application No. PCT/CN2018/115364 filed on Nov. 14, 2018, which claims the benefit of Chinese Patent Application No. 201811020576.9 filed on Sep. 3, 2018. All the above are hereby incorporated by reference in their entirety.

TECHNICAL FIELD

The present invention relates to the field of slide rails, particularly to an oven slide rail handling mechanism with a locking function.

BACKGROUND

An oven, after being used, still has a high temperature. It is not only inconvenient to operate but also is easy to cause a scalding accident when taking out food from or placing food in the oven having such high temperature, having a potential safety hazard.

Therefore, an oven liner is now equipped with a slide rail and a connecting frame, the connecting frame is fixed to inner walls of both sides of an oven, a lower rail of the slide rail is fixedly mounted on the connecting frame, and a baking tray placed in the oven is fastened on an upper rail of the slide rail, so that the baking tray slides with respect to the connecting frame. The structure is simple, and the use is convenient and safe.

However, because the slide rail takes up considerable space of the oven liner, the slide rail is equipped with a holding component facilitating assembly or disassembly in general. An existing holding component includes a horizontal holding part and a vertical holding part, the horizontal holding part and the vertical holding part being held on a transverse rod and a vertical rod respectively.

Although the holding component of the above structure can be tightly held, it is difficult to disassemble the holding component after holding, and is easy to damage the holding component during disassembly.

In view of the above problem, though there is a removable slide rail mounted on left and right grids of an embedded oven in the market, the slide rail including an outer rail of a guide rail and an inner rail of the guide rail which are assembled together by a rolling mechanism, a plurality of hooks being arranged on both sides of the inner rail of the guide rail, the slide rail being hooked on the grids of the oven by the hooks, because the slide rail of the structure is arranged on the racks of the oven by the plurality of hooks, the support area is small, the structural performance is not reliable, being easy to cause the slide rail to come off, affecting the normal use of the oven.

SUMMARY

An object of the present invention is to overcome the defect in the prior art and provide an oven slide rail handling mechanism with a locking function. The mechanism has a good holding effect and reliable structural performance, is able to quickly assemble or disassemble a slide rail, is convenient to operate, facilitates maintenance and replacement, guarantees the use effect of the slide rail, and ensures the normal use of the oven.

The object of the present invention is realized by following technical solution: an oven slide rail handling mechanism with a locking function, comprising a connecting frame mounted on inner walls of both sides of an oven body, and a rail body, wherein an upper rail of the rail body is fitted to a baking tray, and a lower rail of the rail body is provided with a connecting component. The connecting component includes a guide snap for slipping on a transverse rod of the connecting frame in the same horizontal direction as the upper rail, and a front holder, wherein the front holder and the guide snap are respectively mounted at a front end and a rear end of a bottom surface of the lower rail, the guide snap is provided with a snap-fitting position for snap-fitting in a corner position at a rear end of the transverse rod, and the front holder is provided with a latch rod locked in a corner position at a front end of the transverse rod.

According to above optimization, the front holder comprises a U-shaped holding block slipping in the same horizontal direction as the guide snap, an upper end of the U-shaped holding block is provided with a latch fastener slot, a low end of the U-shaped holding block is provided with an open fastener slot and a connecting fastener position, the latch rod is provided with a toggle latch block, an inner-side limiting fastener block and a corner limiting fastener block, the toggle latch block is adaptively fastened or separated in the latch fastener slot, and the inner-side limiting fastener block and the corner limiting fastener block are fastened or separated in the open fastener slot and the connecting fastener position respectively under the driving of the toggle latch block.

According to above optimization, a middle part of the U-shaped holding block is provided with a U-shaped guide groove with an opening provided toward an inner side of the transverse rod, the U-shaped guide groove is in sliding connection with the transverse rod, a front end of the U-shaped guide groove is provided with a limit stop connected with an appropriate end of the corner position of the transverse rod, and the latch fastener slot is provided between the connection of the limit stop and the upper end of the U-shaped holding block.

According to above optimization, holding positions held at a straight bar part of the transverse rod and the corner position are formed by the inner-side limiting fastener block and the corner limiting fastener block which are fastened in the open fastener slot and the connecting fastener position and the U-shaped guide groove.

According to above optimization, the upper end of the U-shaped holding block is provided with a limiting fastener hole corresponding to the inner-side limiting fastener block, and the inner-side limiting fastener block is buckled on the limiting fastener hole while being fastened in the open fastener slot.

According to above optimization, a positioning end of the latch rod is connected to a rear end of the front holder in a positioning mode, a swing end of the latch rod is swung up and down by taking the positioning end thereof as a fixed point, and the swing end of the latch rod is outward folded to form the inner-side limiting fastener block, the corner limiting fastener block and the toggle latch block respectively.

According to above optimization, the inner-side limiting fastener block presents a 7-shaped limiting fastener block connected with the inner side of the transverse rod, the corner limiting fastener block presents an oblique limiting fastener block snap-fitted in the corner position of the transverse rod, and the toggle latch block presents a Z-shaped toggle latch block conveniently operated.

According to above optimization, the guide snap includes a guide support block supported on a bottom surface of the rail body, a guide block for sliding on the transverse rod in the same horizontal direction as the upper rail, and clamping blocks snap-fitted or separated in the corner position at the rear end of the transverse rod as the guide block slides, wherein the clamping blocks are symmetrically arranged on a bottom surface at a right end of the guide support block from front to back, and the guide block is arranged on a bottom surface at a left end of the guide support block located in front of the clamping blocks.

According to above optimization, the clamping blocks extend to an outer side of the guide support block and form a snap-fitting position for being snap-fitted with or separated from the corner position of the transverse rod together with the bottom surface of the lower rail of the rail body, each end of the snap-fitting position is provided with a guide bevel which is convenient for the corner position at the rear end of the transverse rod to slide in; and the left end of the guide support block is downward folded to form the guide block, and a guide groove which has a guide opening facing downward and is in sliding connection with the transverse rod is formed by the guide block and the clamping blocks.

The present invention has the advantages that: under the structure coordination between the guide snap and the front holder, the guide snap and the front holder are slidably mounted on the transverse rod of the connecting frame; when the guide snap and the front holder slip to the corner positions at the two ends of the transverse rod, there is only a need to lock the latch rod onto the front holder, to make the guide snap and the front holder be held at the two ends of the transverse rod respectively, so the mechanism has a locking function while achieving the effect of quickly assembling the slide rail on an oven liner, has a holding effect, preventing the slide rail from being disengaged from the connecting frame, improving the reliability of structural performance, ensuring the use effect of the slide rail, guaranteeing the use quality of an oven. When the slide rail is disassembled, there is only a need to toggle the latch rod, to disengage the latch rod from the front holder, so as to make the front holder and the guide snap slide off the transverse rod in sequence, thus it is achieved that the slide rail is quickly disassembled, thereby facilitating replacement and maintenance, improving the use quality of the slide rail, guaranteeing the use effect of the oven.

DETAILED DESCRIPTION

The present invention will be further described as below with reference to the drawings.

Figure 1:
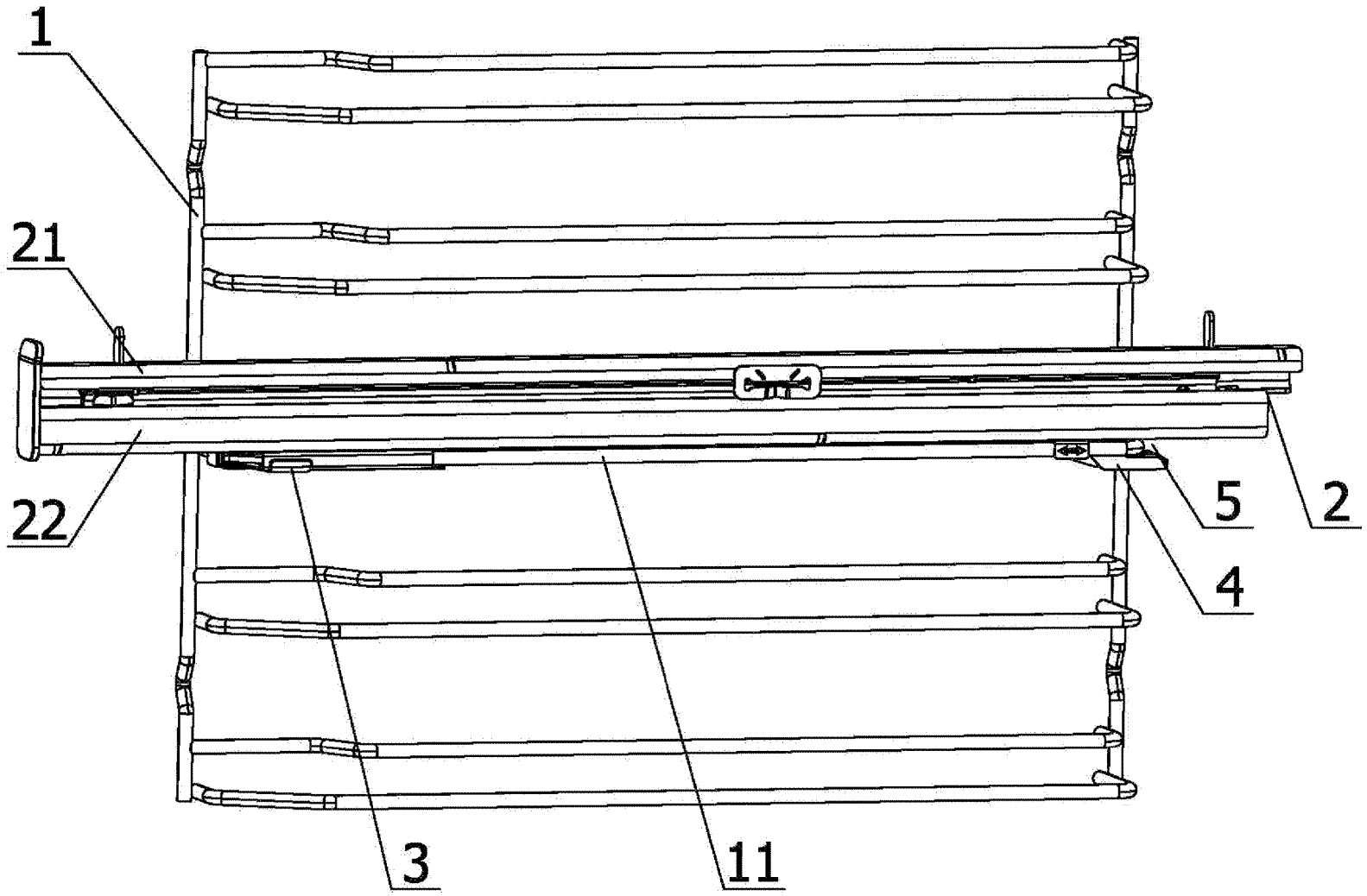
FIG. 1 is a structural schematic diagram of the preferred embodiment of the present invention.
Figure 2:
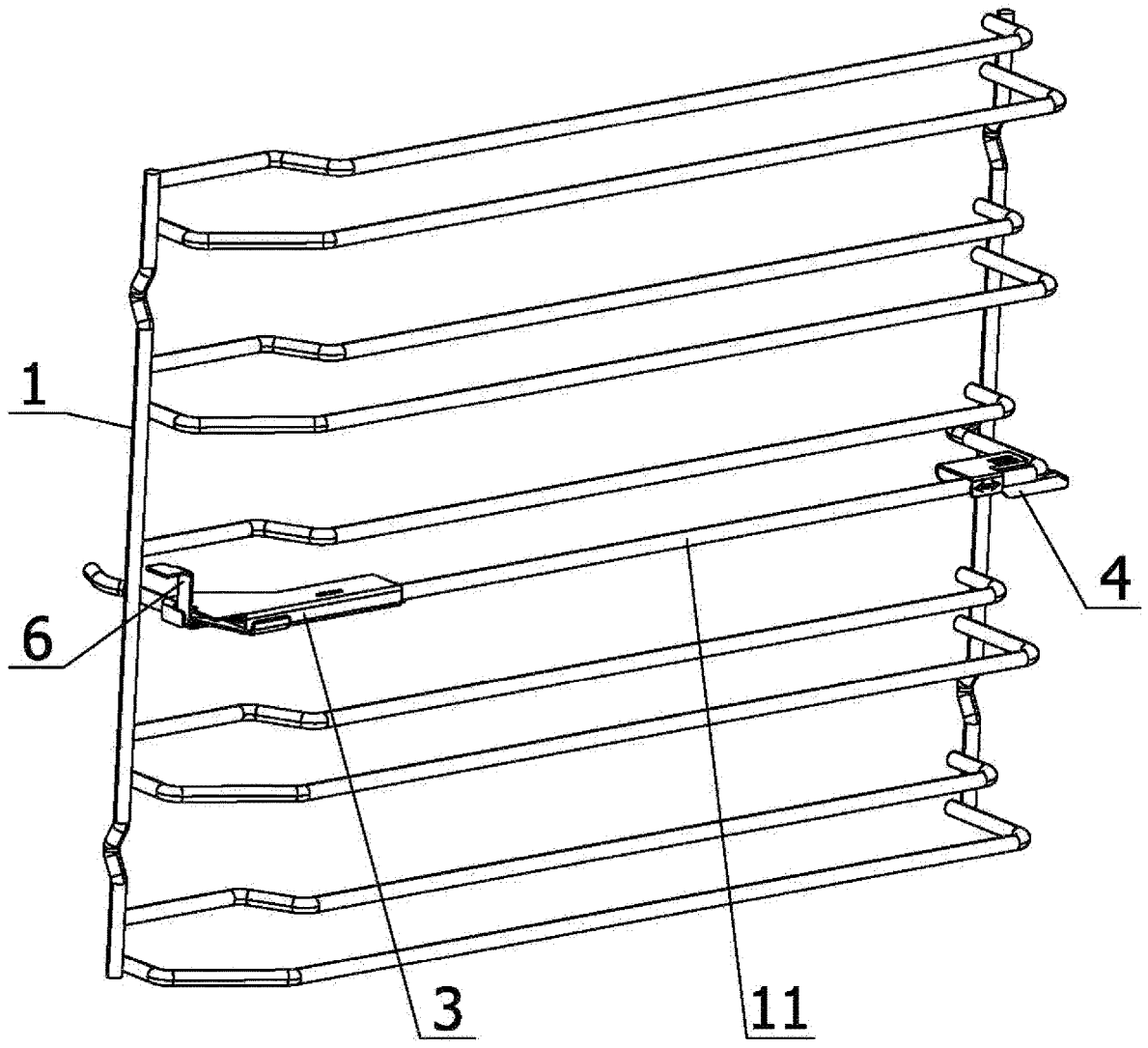
FIG. 2 is a structural schematic diagram of the preferred embodiment of the present invention (with rail body removed).
Figure 3:
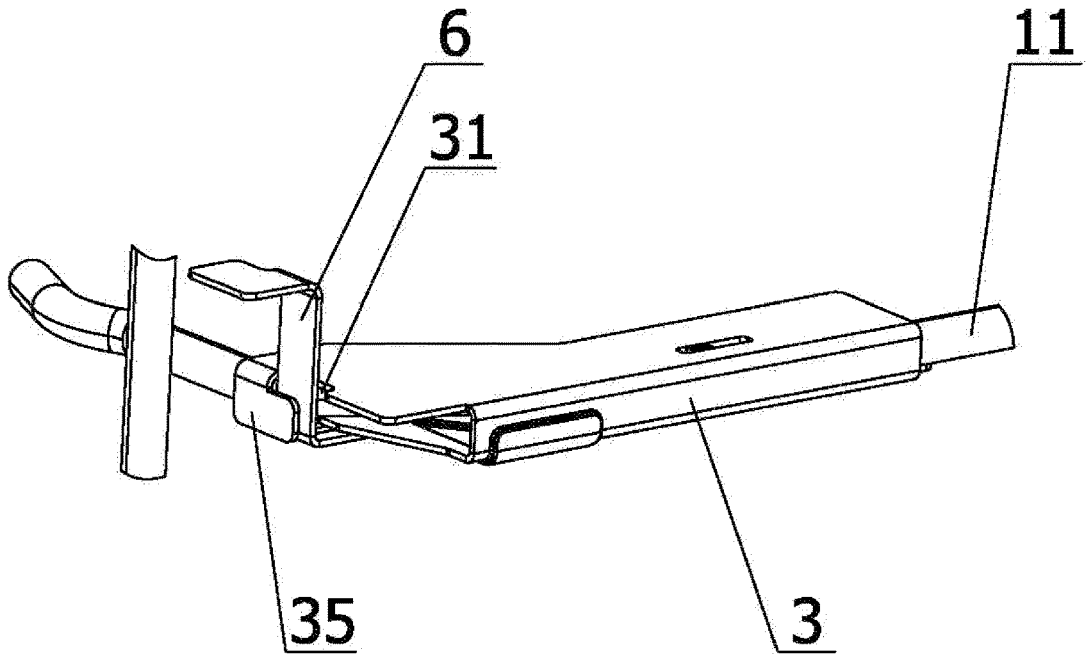
FIG. 3 is an installation diagram of the front holder and the latch rod in the preferred embodiment of the present invention (with rail body removed).
Figure 4:
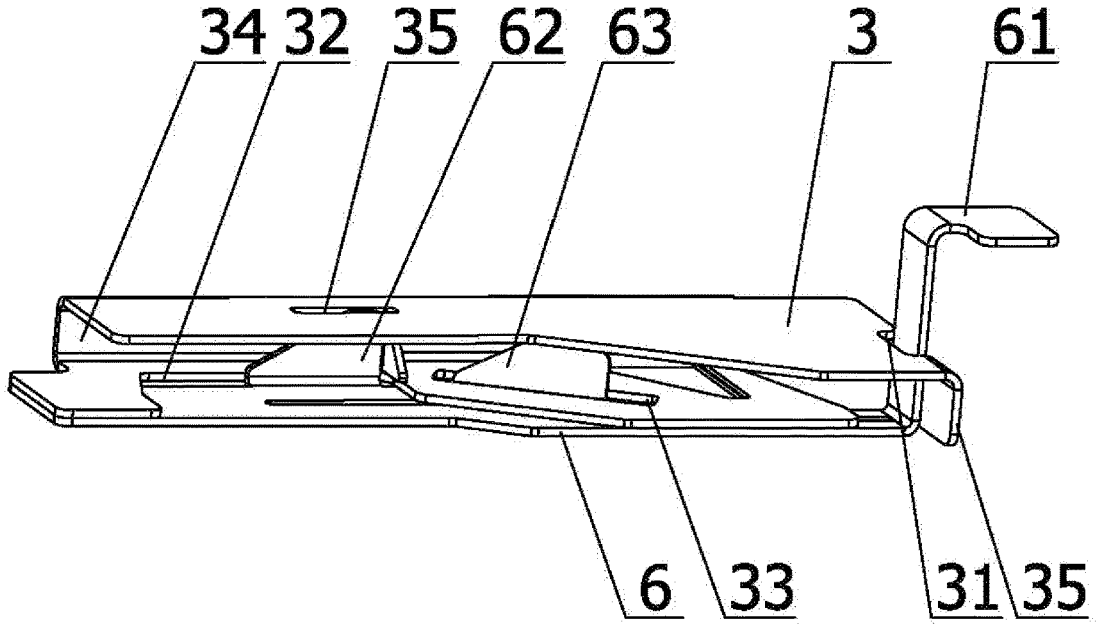
FIG. 4 is a structural diagram showing the installation of the front holder and the latch rod in the preferred embodiment of the present invention.
Figure 5:
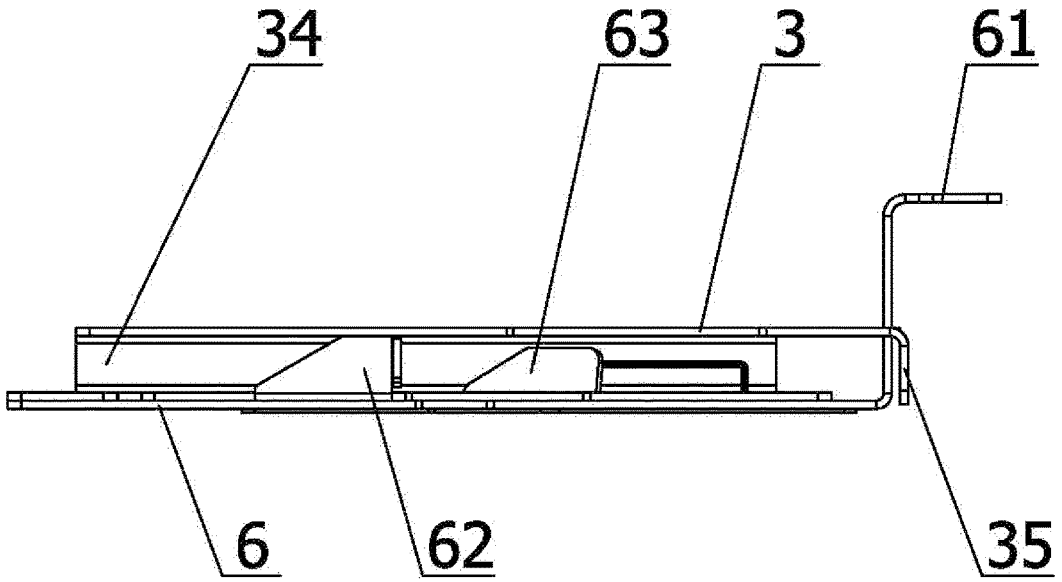
FIG. 5 is a main view showing the installation of the front holder and the latch rod in the preferred embodiment of the present invention.
Figure 6:
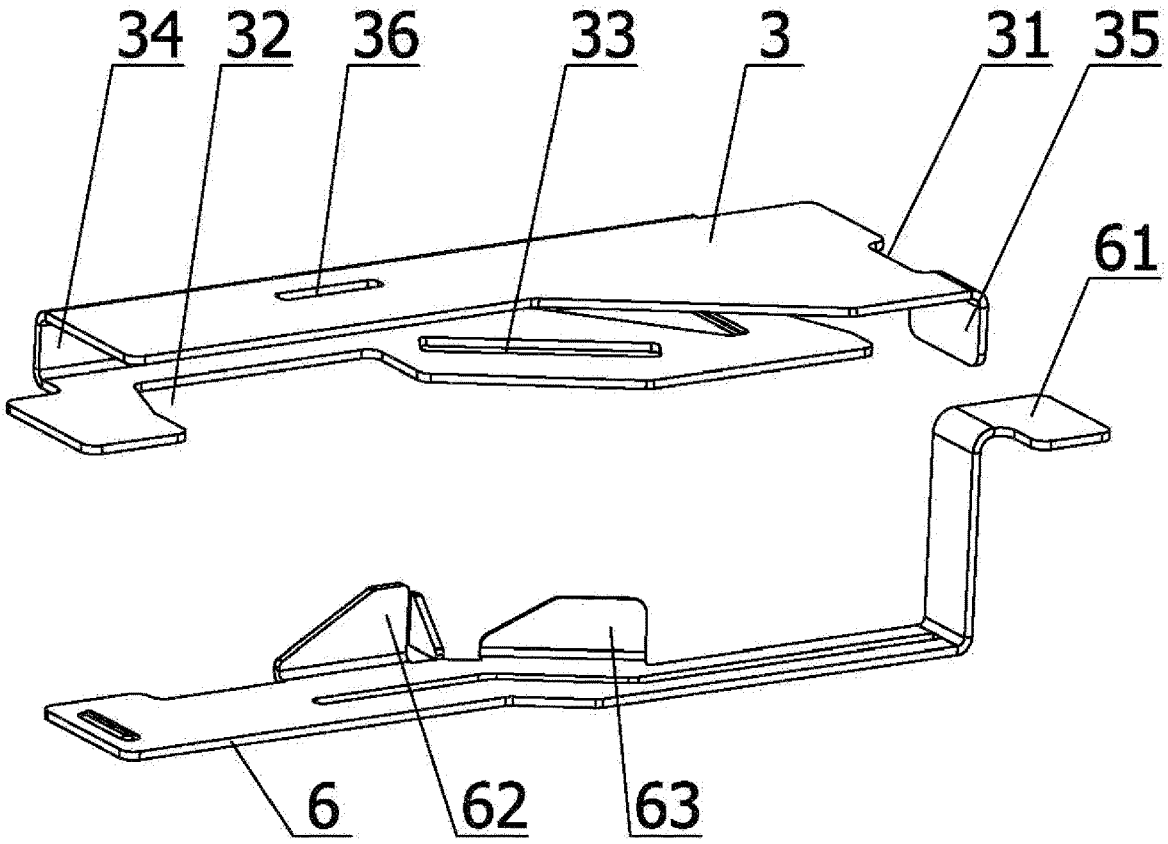
FIG. 6 is an exploded view of the front holder and the latch rod in the preferred embodiment of the present invention.
Figure 7:
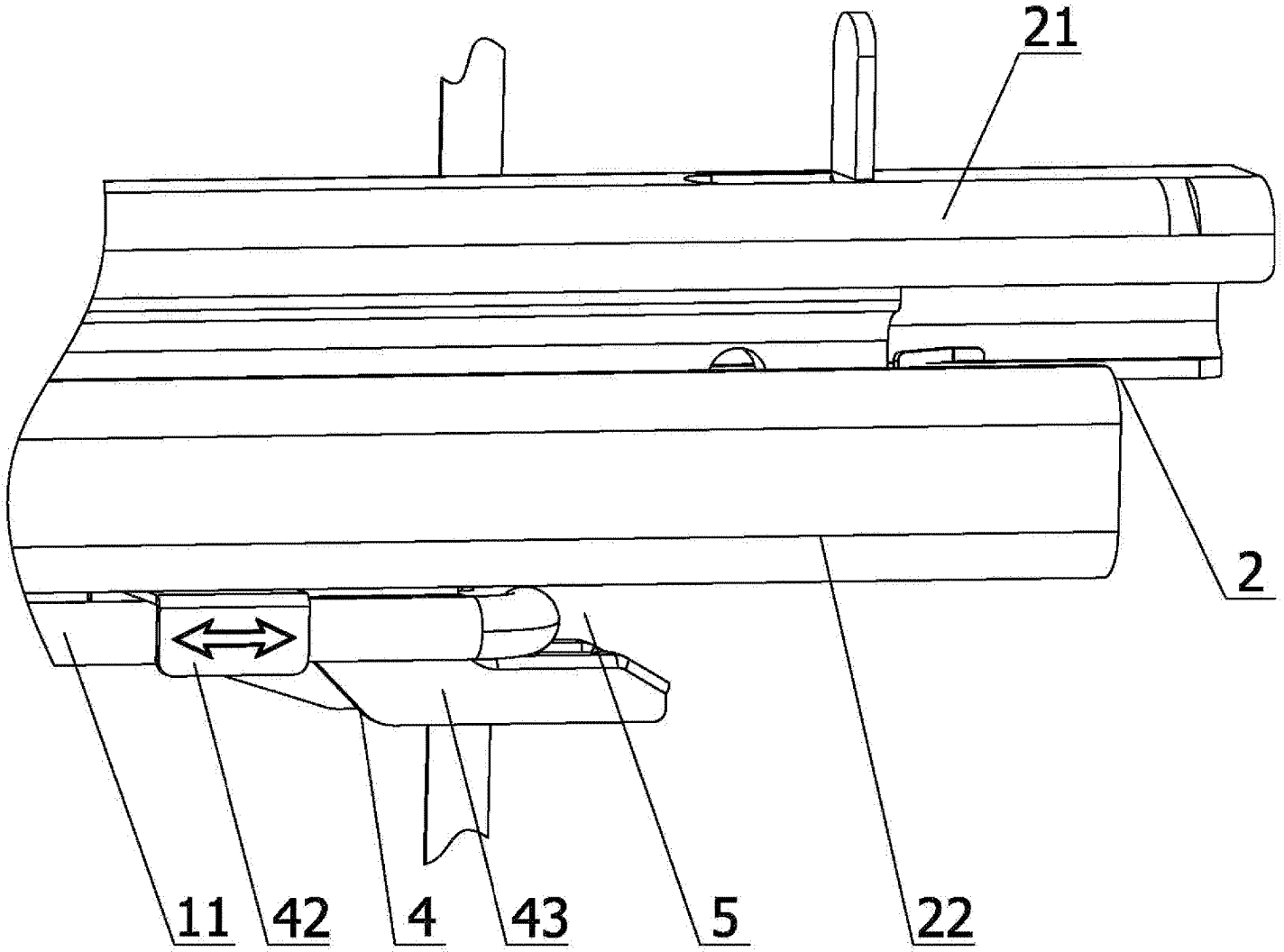
FIG. 7 is an installation diagram of the guide snap in the preferred embodiment of the present invention.
Figure 8:
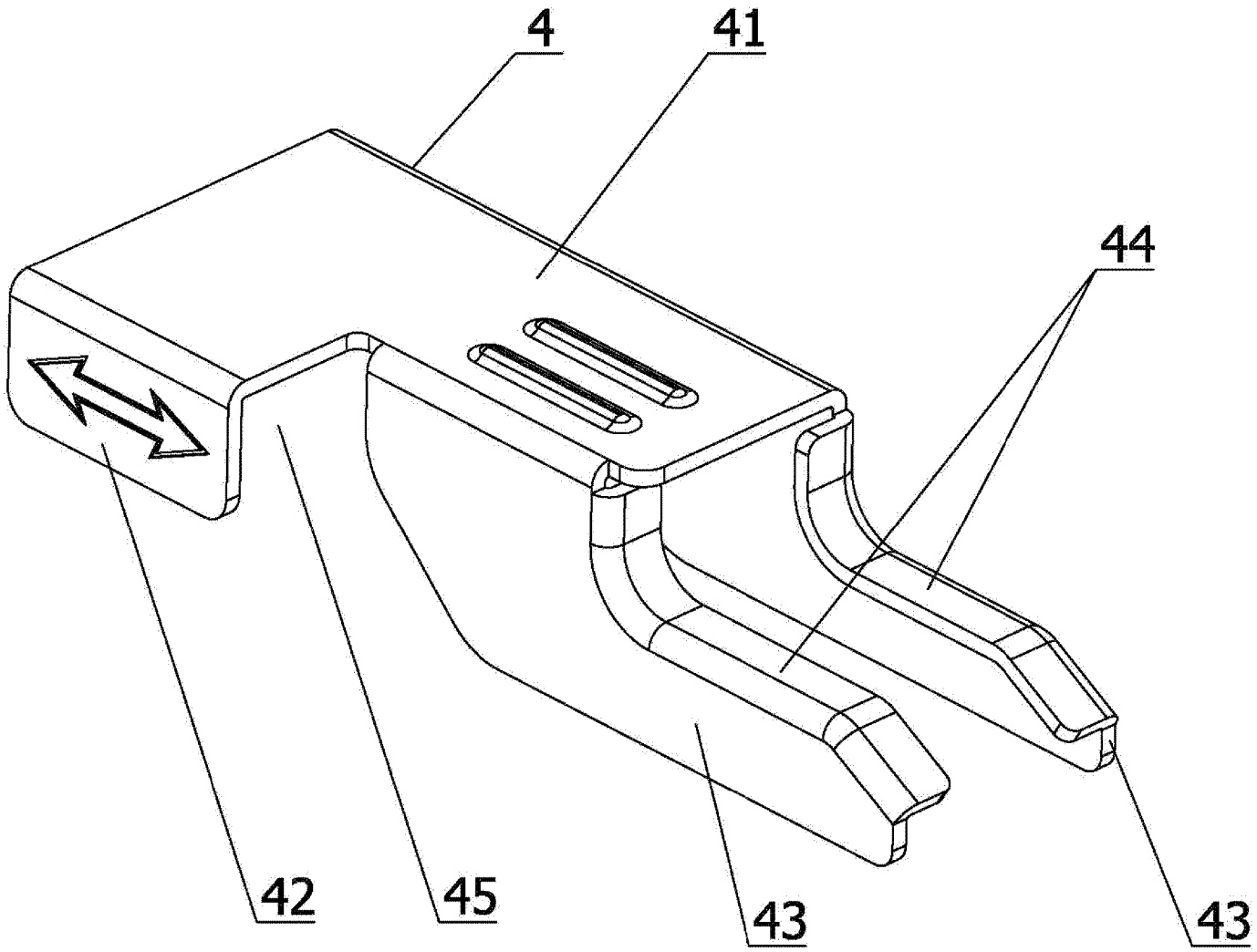
FIG. 8 is a stereographic view of the guide snap in the preferred embodiment of the present invention.

As shown in FIG. 1-FIG. 8, an oven slide rail handling mechanism with a locking function of the present invention, comprising a connecting frame 1 mounted on inner walls of both sides of an oven body, and a rail body 2, wherein an upper rail 21 of the rail body 2 is fitted to a baking tray, and a lower rail 22 of the rail body 2 is provided with a connecting component. The connecting component includes a guide snap 4 for slipping on a transverse rod 11 of the connecting frame 1 in the same horizontal direction as the upper rail 21, and a front holder 3, wherein the front holder 3 and the guide snap 4 are respectively mounted at a front end and a rear end of a bottom surface of the lower rail 22. Moreover, the guide snap 4 is provided with a snap-fitting position 5 for snap-fitting in a corner position at a rear end of the transverse rod 11, and the front holder 3 is provided with a latch rod 6 locked in a corner position at a front end of the transverse rod 11.

That is, when the slide rail is assembled, the guide snap 4 and the front holder 3 are slidably mounted on the transverse rod 11 of the connecting frame 1 in order. When the guide snap 4 and the front holder 3 slip to the corner positions at the two ends of the transverse rod 11, there is only a need to lock the latch rod 6 onto the front holder 3, to make the guide snap 4 and the front holder 3 be held at the two ends of the transverse rod 11 respectively, so the mechanism has a locking function while achieving the effect of quickly assembling the slide rail on an oven liner, has a good holding effect, preventing the slide rail from being disengaged from the connecting frame 1, improving the reliability of structural performance, ensuring the use effect of the slide rail, guaranteeing the use quality of an oven. When the slide rail is disassembled, there is only a need to toggle the latch rod 6, to disengage the latch rod 6 from the front holder 3, so as to make the front holder 3 and the guide snap 4 slide off the transverse rod 11 in sequence. Thus the slide rail is quickly disassembled, facilitating replacement and maintenance, improving the use quality of the slide rail, guaranteeing the use effect of an oven.

As shown in FIG. 1-FIG. 6, the front holder 3 comprises a U-shaped holding block slipping in the same horizontal direction as the guide snap 4. An upper end of the U-shaped holding block is provided with a latch fastener slot 31, and a low end of the U-shaped holding block is provided with an open fastener slot 32 and a connecting fastener position 33. The latch rod 6 is provided with a toggle latch block 61, an inner-side limiting fastener block 62 and a corner limiting fastener block 63. The toggle latch block 61 is adaptively fastened or separated in the latch fastener slot 31, and the inner-side limiting fastener block 62 and the corner limiting fastener block 63 are fastened or separated in the open fastener slot 32 and the connecting fastener position 33 respectively under the driving of the toggle latch block 61.

In practical application, a positioning end of the latch rod 6 is connected to a rear end of the front holder 3 in a positioning mode, and a swing end of the latch rod 6 is swung up and down by taking the positioning end thereof as a fixed point. Moreover, the swing end of the latch rod 6 is outward folded to form the inner-side limiting fastener block 62, the corner limiting fastener block 63 and the toggle latch block 61 respectively. Holding positions held at a straight bar part of the transverse rod 11 and the corner position are formed by the inner-side limiting fastener block 62 and the corner limiting fastener block 63 which are fastened in the open fastener slot 32 and the connecting fastener position 33 and the U-shaped guide groove 34.

When the guide snap 4 and the front holder 3 slip to the corner positions at the two ends of the transverse rod 11, the toggle latch block 61 of the latch rod 6 is toggled, to make the toggle latch block 61 be fastened in the latch fastener slot 31. Meanwhile, the inner-side limiting fastener block 62 and the corner limiting fastener block 63 are fastened in the open fastener slot 32 and the connecting fastener position 33 respectively under the driving of the toggle latch block 61. At this time, holding positions formed by the inner-side limiting fastener block 62 and the corner limiting fastener block 63 and the U-shaped guide groove 34 are respectively held at a straight bar part of the transverse rod 11 and the corner position. In this way, the slide rail is quickly assembled, operation is facilitated, holding in multiple directions is achieved, having a good holding effect, having a locking function, improving the structural stability, improving the use quality of a product.

Then, the toggle latch block 61 of the toggled latch rod 6 is separated from the latch fastener slot 31. Meanwhile, the inner-side limiting fastener block 62 and the corner limiting fastener block are separated from the open fastener slot 32 and the connecting fastener position 33 respectively under the swing of the swing end of the latch rod 6, so that the front holder 3 and the guide snap 4 slide off the transverse rod 11 in sequence, thus the slide rail is quickly disassembled, operation is facilitated, facilitating maintenance and replacement, ensuring the use effect of the slide rail, guaranteeing the normal use of an oven.

Wherein, a middle part of the U-shaped holding block is provided with a U-shaped guide groove 34 with an opening provided toward an inner side of the transverse rod 11. The U-shaped guide groove 34 is in sliding connection with the transverse rod 11, a front end of the U-shaped guide groove 34 is provided with a limit stop 35 connected with an appropriate end of the corner position of the transverse rod 11, and the latch fastener slot 31 is provided between the connection of the limit stop 35 and the upper end of the U-shaped holding block. The slip smoothness of assembly or disassembly is improved, operation is facilitated, a locking effect is improved, improving the structural stability, guaranteeing the use quality of a product.

In addition, the upper end of the U-shaped holding block is provided with a limiting fastener hole 36 corresponding to the inner-side limiting fastener block 62, and the inner-side limiting fastener block 62 is buckled on the limiting fastener hole 36 while being fastened in the open fastener slot 32. Moreover, the inner-side limiting fastener block 62 presents a 7-shaped limiting fastener block connected with the inner side of the transverse rod 11, the corner limiting fastener block 63 presents an oblique limiting fastener block snap-fitted in the corner position of the transverse rod 11, and the toggle latch block 61 presents a Z-shaped toggle latch block conveniently operated. The reliability of structural performance is further improved, assembly or disassembly is facilitated, improving the use effect of a product.

As shown in FIGS. 1, 2, 7 and 8, the clamping blocks 43 extend to an outer side of the guide support block 41 and form a snap-fitting position 5 for being snap-fitted with or separated from the corner position of the transverse rod 11 together with the bottom surface of the lower rail 22 of the rail body 2. Each end of the snap-fitting position 5 is provided with a guide bevel 44 which is convenient for the corner position at the rear end of the transverse rod 11 to slide in. Under the structure coordination between the snap-fitting position 5 and the holding position, holding in multiple positions is achieved, the stability of assembly is improved; and under the action of the guide bevel 44, the support area is increased, the compressive strength is increased, the holding stability is further improved, ensuring the use effect of the slide rail, guaranteeing the normal use of an oven.

In addition, the left end of the guide support block 41 is downward folded to form a guide block 42, and a guide groove 45 which has a guide opening facing downward and is in sliding connection with the transverse rod 11 is formed by the guide block 42 and the clamping blocks 43. The guide snap 4 and the front holder 3 are slidably assembled on the connecting frame 1 in sequence, the traditional linear slide assembling mode is replaced, the smoothness of assembly or disassembly is improved, operation is facilitated, the phenomenon of wrong assembly is effectively avoided, guaranteeing the use quality of the slide rail.

The above specific embodiments are specific embodiments with good effects of the present invention. Any structure identical or similar to that of the oven slide rail handling mechanism with a locking function of present invention shall be covered in the protection scope of the present invention.

What is claimed is:

1. An oven slide rail handling mechanism with a locking function, comprising a connecting frame (1) mounted on inner walls of both sides of an oven body, and a rail body (2), wherein an upper rail (21) of the rail body (2) is fitted to a baking tray, and a lower rail (22) of the rail body (2) is provided with a connecting component, characterized in that: the connecting component includes a guide snap (4) for slipping on a transverse rod (11) of the connecting frame (1) in the same horizontal direction as the upper rail (21), and a front holder (3), wherein the front holder (3) and the guide snap (4) are respectively mounted at a front end and a rear end of a bottom surface of the lower rail (22), the guide snap (4) is provided with a snap-fitting position (5) for snap-fitting in a corner position at a rear end of the transverse rod (11), and the front holder (3) is provided with a latch rod (6) locked in a corner position at a front end of the transverse rod (11);

a positioning end of the latch rod (6) is connected to a rear end of the front holder (3) in a positioning mode, a swing end of the latch rod (6) is swung up and down by taking the positioning end thereof as a fixed point, and the swing end of the latch rod (6) is outward folded to form an inner-side limiting fastener block (62), a corner limiting fastener block (63) and a toggle latch block (61) respectively.

2. The oven slide rail handling mechanism with a locking function according to claim 1, characterized in that the front holder (3) comprises a U-shaped holding block slipping in the same horizontal direction as the guide snap (4), an upper end of the U-shaped holding block is provided with a latch fastener slot (31), a low end of the U-shaped holding block is provided with an open fastener slot (32) and a connecting fastener position (33), the latch rod (6) is provided with a toggle latch block (61), an inner-side limiting fastener block (62) and a corner limiting fastener block (63), the toggle latch block (61) is adaptively fastened or separated in the a latch fastener slot (31), and the inner-side limiting fastener block (62) and the corner limiting fastener block (63) are fastened or separated in the open fastener slot (32) and the connecting fastener position (33) respectively under the driving of the toggle latch block (61).

3. The oven slide rail handling mechanism with a locking function according to claim 2, characterized in that a middle part of the U-shaped holding block is provided with a U-shaped guide groove (34) with an opening provided toward an inner side of the transverse rod (11), the U-shaped guide groove (34) is in sliding connection with the transverse rod (11), a front end of the U-shaped guide groove (34) is provided with a limit stop (35) connected with an appropriate end of the corner position of the transverse rod (11), and the latch fastener slot (31) is provided between the connection of the limit stop (35) and the upper end of the U-shaped holding block.

4. The oven slide rail handling mechanism with a locking function according to claim 3, characterized in that holding positions held at a straight rod part of the transverse rod (11) and the corner position are formed by the inner-side limiting fastener block (62) and the corner limiting fastener block (63) which are fastened in the open fastener slot (32) and the connecting fastener position (33) and the U-shaped guide groove (34).

5. The oven slide rail handling mechanism with a locking function according to claim 4, characterized in that a positioning end of the latch rod (6) is connected to a rear end of the front holder (3) in a positioning mode, a swing end of the latch rod (6) is swung up and down by taking the positioning end thereof as a fixed point, and the swing end of the latch rod (6) is outward folded to form the inner-side limiting fastener block (62), the corner limiting fastener block (63) and the toggle latch block (61) respectively.

6. The oven slide rail handling mechanism with a locking function according to claim 5, characterized in that the inner-side limiting fastener block (62) presents a 7-shaped limiting fastener block connected with the inner side of the transverse rod (11), the corner limiting fastener block (63) presents an oblique limiting fastener block snap-fitted in the corner position of the transverse rod (11), and the toggle latch block (61) presents a Z-shaped toggle latch block conveniently operated.

7. The oven slide rail handling mechanism with a locking function according to claim 3, characterized in that a positioning end of the latch rod (6) is connected to a rear end of the front holder (3) in a positioning mode, a swing end of the latch rod (6) is swung up and down by taking the positioning end thereof as a fixed point, and the swing end of the latch rod (6) is outward folded to form the inner-side limiting fastener block (62), the corner limiting fastener block (63) and the toggle latch block (61) respectively.

8. The oven slide rail handling mechanism with a locking function according to claim 7, characterized in that the inner-side limiting fastener block (62) presents a 7-shaped limiting fastener block connected with the inner side of the transverse rod (11), the corner limiting fastener block (63) presents an oblique limiting fastener block snap-fitted in the corner position of the transverse rod (11), and the toggle latch block (61) presents a Z-shaped toggle latch block conveniently operated.

9. He oven slide rail handling mechanism with a locking function according to claim 2, characterized in that the upper end of the U-shaped holding block is provided with a limiting fastener hole (36) corresponding to the inner-side limiting fastener block (62), and the inner-side limiting fastener block (62) is buckled on the limiting fastener hole (36) while being fastened in the open fastener slot (32).

10. The oven slide rail handling mechanism with a locking function according to claim 9, characterized in that a positioning end of the latch rod (6) is connected to a rear end of the front holder (3) in a positioning mode, a swing end of the latch rod (6) is swung up and down by taking the positioning end thereof as a fixed point, and the swing end of the latch rod (6) is outward folded to form the inner-side limiting fastener block (62), the corner limiting fastener block (63) and the toggle latch block (61) respectively.

11. The oven slide rail handling mechanism with a locking function according to claim 10, characterized in that the inner-side limiting fastener block (62) presents a 7-shaped limiting fastener block connected with the inner side of the transverse rod (11), the corner limiting fastener block (63) presents an oblique limiting fastener block snap-fitted in the corner position of the transverse rod (11), and the toggle latch block (61) presents a Z-shaped toggle latch block conveniently operated.

12. The oven slide rail handling mechanism with a locking function according to claim 2, characterized in that a positioning end of the latch rod (6) is connected to a rear end of the front holder (3) in a positioning mode, a swing end of the latch rod (6) is swung up and down by taking the positioning end thereof as a fixed point, and the swing end of the latch rod (6) is outward folded to form the inner-side limiting fastener block (62), the corner limiting fastener block (63) and the toggle latch block (61) respectively.

13. The oven slide rail handling mechanism with a locking function according to claim 12, characterized in that the inner-side limiting fastener block (62) presents a 7-shaped limiting fastener block connected with the inner side of the transverse rod (11), the corner limiting fastener block (63) presents an oblique limiting fastener block snap-fitted in the corner position of the transverse rod (11), and the toggle latch block (61) presents a Z-shaped toggle latch block conveniently operated.

14. The oven slide rail handling mechanism with a locking function according to claim 1, characterized in that the inner-side limiting fastener block (62) presents a 7-shaped limiting fastener block connected with the inner side of the transverse rod (11), the corner limiting fastener block (63) presents an oblique limiting fastener block snap-fitted in the corner position of the transverse rod (11), and the toggle latch block (61) presents a Z-shaped toggle latch block conveniently operated.

15. The oven slide rail handling mechanism with a locking function according to claim 1, characterized in that the guide snap (4) includes a guide support block (41) supported on a bottom surface of the rail body (2), a guide block (42) for sliding on the transverse rod (11) in the same horizontal direction as the upper rail (21), and clamping blocks (43) snap-fitted or separated in the corner position at the rear end of the transverse rod (11) as the guide block (42) slides, wherein the clamping blocks (43) are symmetrically arranged on a bottom surface at a right one end of the guide support block (41) from front to back, and the guide block (42) is arranged on a bottom surface at a left end of the guide support block (41) located in front of the clamping blocks (43).

16. The oven slide rail handling mechanism with a locking function according to claim 15 characterized in that the clamping blocks (43) extend to an outer side of the guide support block (41) and form a snap-fitting position (5) for being snap-fitted with or separated from the corner position of the transverse rod (11) together with the bottom surface of the lower rail (22) of the rail body (2), each end of the snap-fitting position (5) is provided with a guide bevel (44)

which is convenient for the corner position at the rear end of the transverse rod (11) to slide in; and the left end of the guide support block (41) is downward folded to form the guide block (42), and a guide groove (45) which has a guide opening facing downward and is in sliding connection with the transverse rod (11) is formed by the guide block (42) and the clamping blocks (43).

* * * * *